US006710697B1

(12) United States Patent
Houck, III

(10) Patent No.: US 6,710,697 B1
(45) Date of Patent: Mar. 23, 2004

(54) FLEXIBLE CABLE OPERATED FUSE SWITCH

(75) Inventor: Theodore John Houck, III, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/298,353

(22) Filed: Nov. 18, 2002

(51) Int. Cl.[7] ..... H01H 85/044; H01H 85/25

(52) U.S. Cl. ..... 337/196; 337/189; 337/245; 200/331; 200/337; 361/115

(58) Field of Search ..... 337/158, 161, 337/168, 186, 189, 196, 245; 361/104, 115; 200/50.33, 330, 331, 336, 337

(56) References Cited

U.S. PATENT DOCUMENTS 2,418,006 A * 3/1947 Bangert, Jr. ..... 200/330
3,939,725 A * 2/1976 Fisher ..... 74/503
4,031,343 A * 6/1977 Sopko ..... 200/61.12
4,626,638 A * 12/1986 Samples et al. ..... 200/331
5,428,196 A * 6/1995 Beatty et al. ..... 200/329
5,466,902 A * 11/1995 Blom et al. ..... 200/50.21
5,594,610 A * 1/1997 Robirds et al. ..... 361/104
5,726,401 A * 3/1998 Green et al. ..... 200/50.33
5,814,777 A * 9/1998 Green et al. ..... 220/50.33
5,973,279 A * 10/1999 Turner et al. ..... 200/331
6,504,460 B2 * 1/2003 DeGrazia et al. ..... 335/68
6,590,756 B2 * 7/2003 Meiners et al. ..... 361/62

OTHER PUBLICATIONS

Cutler–Hammer, Flex Shaft CH Handle Mechanism for Flange Mounting, Admitted Prior Art.
Cutler–Hammer, Installation Instructions for "Type AMT Vari–Depth/Vari–Width Handle Mechanism for Below Handle Mounting on L–Frame Series . . . ", Admitted Prior Art.

* cited by examiner

*Primary Examiner*—Anatoly Vortman
(74) *Attorney, Agent, or Firm*—Quarles & Brady LLP; Alexander M. Gerasimow

(57) ABSTRACT

A switching apparatus is provided for a fuse block that is disposed in a cabinet. The switching apparatus enables a user to connect and disconnect the fuse block from its power source when the interior of the cabinet is accessed. Locking mechanisms are provided to prevent the power supply from being reconnected to the fuse block 50 until cabinet door is closed, and the switching apparatus is turned on.

17 Claims, 4 Drawing Sheets

FIG. 3
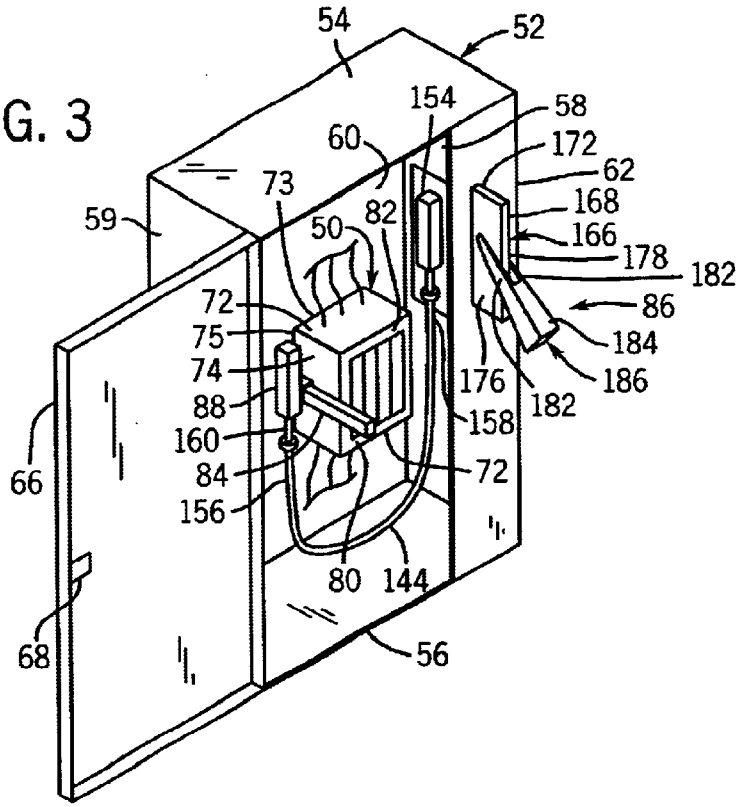
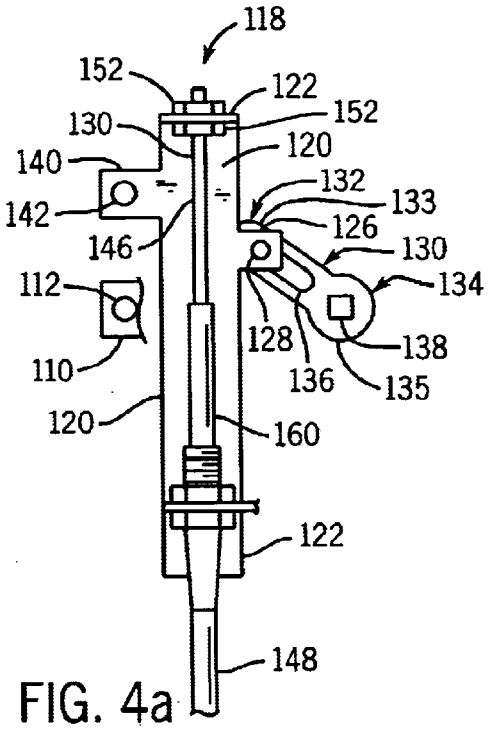
FIG. 4a
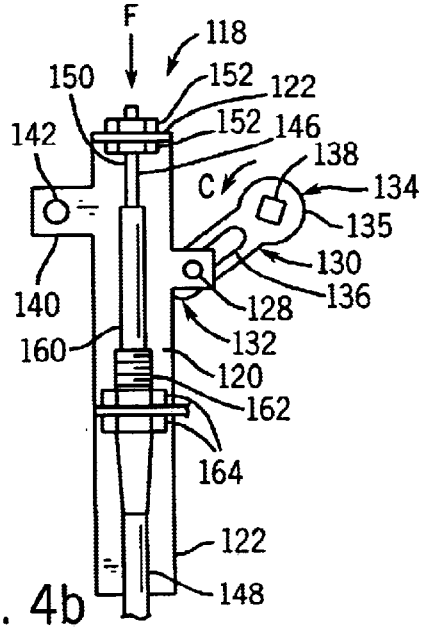
FIG. 4b

FLEXIBLE CABLE OPERATED FUSE SWITCH

BACKGROUND OF THE INVENTION

1. Field of the Invention

The present invention relates to fuse blocks generally, and in particular to a switching apparatus for selectively connecting and disconnecting a fuse block from its power source.

2. Discussion of the Related Art

Molded case fuse blocks are well known in the art for protecting electrical circuitry from damage due to power surges and the like. In particular, conventional fuse blocks are typically disposed within a cabinet to protect the associated electric circuitry from the external environment. In order to reduce the possibility of inadvertent contact with the live wiring inside the cabinet, it had become desirable to provide a system for automatically electrically disconnecting the fuse block from power when the cabinet door is opened.

For example, referring to FIG. 1, a cabinet 10 is provided having opposing upper and lower walls 12 and 14, respectively, connecting at their left and right ends to opposing side walls 16. The back end of the cabinet 10 is enclosed by a rear wall 18, and at its front end by a door 20. Door 20 is hingedly connected to one of the side walls 16. A fuse block 22 is mounted to the inner surface of rear wall 18 such that fuses 24 are easily accessible to the user when door 20 is open. A series of electrical input leads 26 connect the fuse block 22 to a remote power source (not shown). A set of electrical output leads 28 extend through the lower wall 14 and connect the fuse block 22 to other circuitry. An operator 30 extends outwardly from fuse block 22 towards door 20, and is rotatable about its axis of extension to electrically connect and disconnect fuses 24 from electrical input leads 26.

Referring now also to FIG. 2, door 20 includes a door knob 32 that is configured to engage the rotatable operator 30. In particular, a pair of cylindrical locking pins 34 extends horizontally outwardly from either side of the outer end 31 of rotatable operator 30. A corresponding keyhole 36 is disposed in door knob 32, and includes a first horizontally extending slot 38 sized to receive locking pins 34. Key hole 36 further includes a second vertically extending slot 40 that intersects with slot 38 and is sized to receive the outer end 31 of rotational operator 30.

During operation, when door 20 is closed, rotatable operator 30 and corresponding locking pins 34 are inserted into keyhole 36 of door knob 32. Door knob 32 is subsequently rotated counterclockwise along the direction of arrow A, which further causes keyhole 36 to correspondingly rotate rotational operator 30 counterclockwise in the direction of arrow B to once again establish electrical connection between fuse block 22 and the power source. As door knob 32 is rotated in the direction of arrow A, a door latch (not shown) locks the door 20 in a closed position. Accordingly, in order to subsequently open the door 20, door knob 32 is rotated clockwise to unlock the door 20 and automatically rotate operator 30 to disconnect the fuse block 22 with the power source.

A user is therefore advantageously unable to access the interior of cabinet 10 without first disconnecting the fuse block 22 from the power source via operator 30. However, this system suffers from drawbacks related to both fabrication and use. For example, the fuse block 22 and door knob 32 must be precisely mounted in their proper location in order to ensure that keyhole 36 is in mating alignment with locking pins 34. This is a difficult and sometimes tedious time consuming process. Additionally, when the door 20 is open, and fuse block 22 is disconnected from the power source, the user has the ability to manually rotate operator 30 in the direction of arrow B to reconnect the fuse block 22 and the power source while cabinet 10 is open.

What is therefore needed is a switching apparatus for a fuse block that avoids the manufacturing difficulties associated with conventional designs, and that limits a user's ability to inadvertently turn the fuse block on while the cabinet door is open.

BRIEF SUMMARY OF THE INVENTION

In accordance with one aspect of the invention, a switching apparatus is provided for a fuse block that is disposed in a cabinet. The fuse block is of the type having at least one fuse operable to conduct current from a power source to a load and rotatable operator extending along an axis is operable to rotate about the axis between a closed and open position to correspondingly electrically connect and disconnect the fuse block with respect to the power source. The switching apparatus includes a handle mechanism that is mountable to a cabinet surface and movable between a first position and a second position. An actuating mechanism is provided having (A) a stationary member fixed relative to the fuse block; (B) a movable member movably connected to the stationary member; and (C) a linkage linked to the movable member and connected to the rotatable operator for rotating the rotatable operator in response to movement of the movable member. A cable assembly is attached to the handle at a first end and attached to the actuating mechanism at a second end opposite the first end. Movement of the handle mechanism from the first position to the second position causes the cable to translate the movable member with respect to the fuse block, thereby rotating the linkage and rotatable operator to electrically disconnect the fuse block from the power source.

The above aspects of the invention are not intended to define the scope of the invention for which purpose claims are provided. In the following description, reference is made to the accompanying drawings, which form a part hereof and in which there is shown by way of illustration, and not limitation, a preferred embodiment of the invention Such embodiment does not define the scope of the invention and reference must be made therefore to the claims for this purpose.

BRIEF DESCRIPTION OF THE DRAWINGS

Reference is hereby made to the following figures in which like reference numerals correspond to like elements throughout, and in which:

FIG. 3 is a perspective view of a fuse block and corresponding switch assembly constructed in accordance with the preferred embodiment of the present invention having sections cut away from the cabinet, the fuse block and switching assembly being in the "OFF" position;

FIG. 4*a* is a side elevation view of the actuating mechanism illustrated in FIG. 3 connected to the fuse block in a first "ON" position;

FIG. 4*b* is a side elevation view of the actuating mechanism illustrated in FIG. 4*a* but in a second "OFF" position;

DETAILED DESCRIPTION OF THE INVENTION

Figure 1:
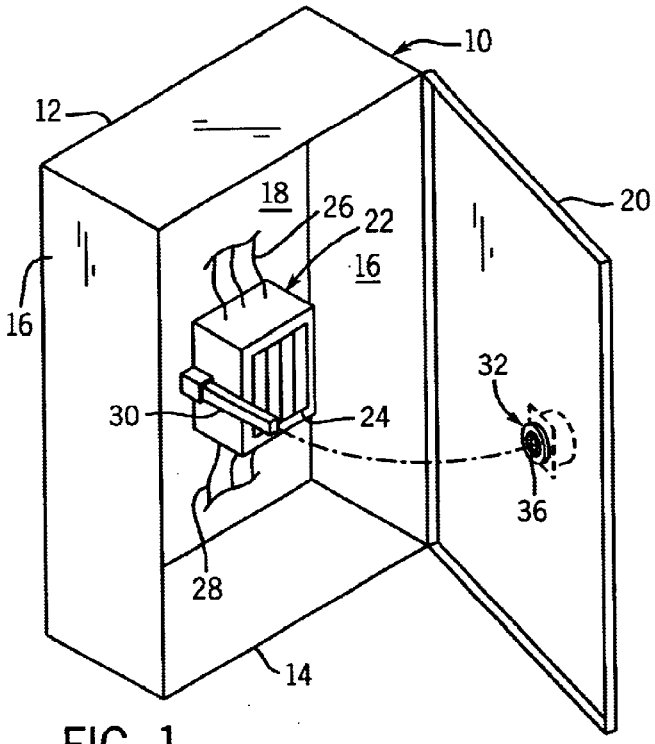
FIG. 1 PRIOR ART
FIG. 1 is a perspective view of a fuse block installed in a cabinet in accordance with conventional techniques.
Figure 2:
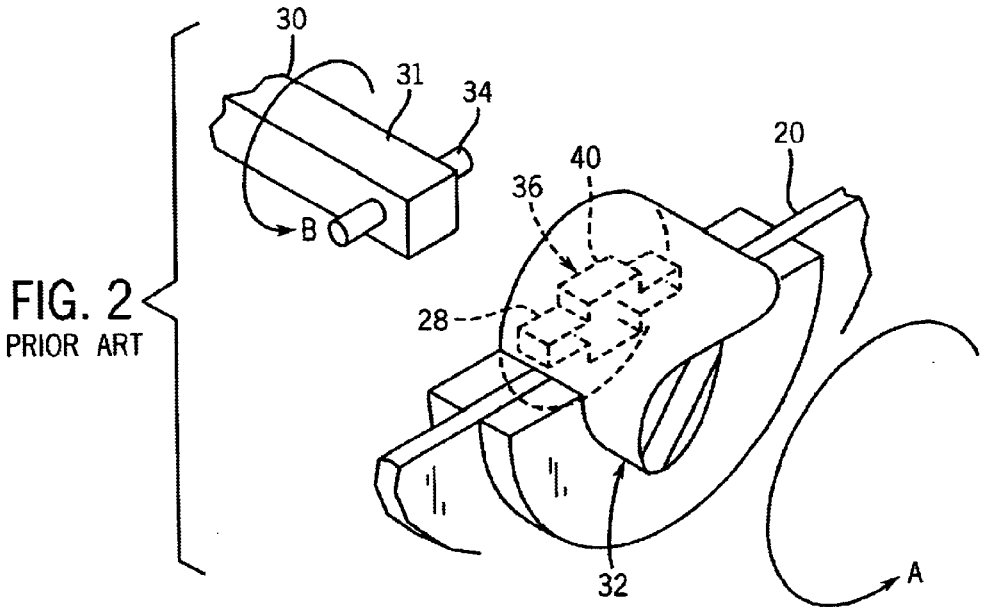
FIG. 2 PRIOR ART
FIG. 2 is a perspective view illustrating the interaction between the rotational operator and door knob of FIG. 1.

Referring to FIG. 3, a fuse block 50 constructed in accordance with the preferred embodiment is mounted inside a cabinet 52 having upper and lower walls 54 and 56, respectively, that are connected to opposing side walls 58 and 59. A rear wall 60 is connected to the back ends of walls 54, 56, 58, and 59. A wall segment 62 extends vertically from upper wall 54 to lower wall 56 at the front of cabinet 52 proximal side wall 58, and extends only partially towards the opposing side wall 59. The remaining portion of the front end of cabinet 52 is occupied by a door 66 that is hingedly connected to side wall 59 and extends laterally such that outer edge 66 of door 66 connects to wall segment 62 by way of a latch 68 to enclose the cabinet 52 when door 66 is closed.

Figure 6:
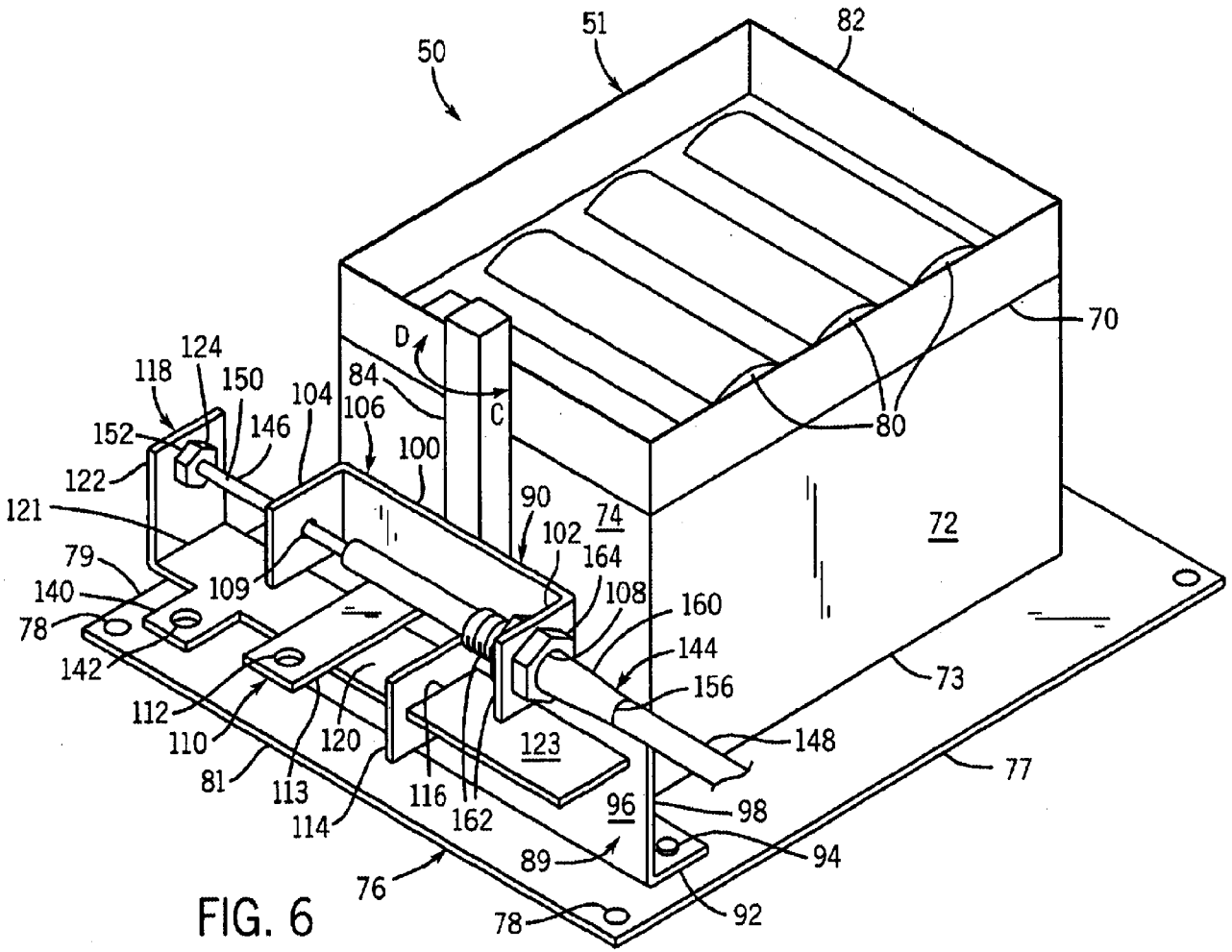
FIG. 6 is an exploded perspective view of the fuse block and switch assembly illustrated in FIG. 3 in the "ON" position.

A switching assembly 86 includes a handle mechanism 166 that is mounted onto wall segment 62 in a vertical orientation. Handle mechanism includes a handle that is in mechanical communication with a cable assembly 144. Referring now also to FIG. 6, an actuator 88 is linked to fuse block 50 and operable to electrically connect and disconnect the fuse block from its power source. Cable assembly 144 extends downstream from handle mechanism 166 and is connected to actuator 88, such that handle 186 be manually actuated between an "ON" and "OFF" position to electrically connect and disconnect the fuse block 50 from the power source, as is described in more detail below.

Fuse block 50 is one of several types of conventional fuse blocks, such as is commercially available by Allen Bradley under Catalog No. 194R-NJ030P3 B. Fuse block 50 includes a fuse block housing 51 that is mounted onto a base plate 76. Base plate 76 defines a front edge 77, a rear edge 79, a first lateral side edge 81, and a second opposing lateral side edge (not shown). Base plate 76 is rectangular in cross-section, and defines a plurality of apertures 78 extending therethrough proximal each of its comers adjacent the intersection of its edges for mounting the fuse block 50 in cabinet 52. For the purposes of this description, rear edge 79 is said to be disposed "downstream" of front edge 77 in the longitudinal direction, and side edge 81 is said to be disposed "laterally outwardly" with respect to fuse block housing 51.

Fuse block housing 51 includes a top wall 70, opposing front walls 72, and opposing lateral side walls 74. The bottom edges 73 and 75 of walls 72 and 74, respectively, are connected to a base plate 76 via screws (not shown) or one of many alternative well-known fastening techniques. Upper wall 70 of fuse block defines three chambers 80 formed therein for receiving corresponding fuses that are electrically connected to an external electrical device that is disposed remotely with respect to cabinet 52. In particular, a set of input leads 55 extends through rear wall 60, and connects the remote power source to fuse block 50. A set of output leads 57 extends through lower wall 56 and is connected to the external electrical device. A transparent cover 82 is mounted on to upper wall 70 and encases housings 80. Cover 82 is mounted to upper wall 70 so as to be easily removable to allow access to fuses 80. While fuse block 50 is three phase in accordance with the illustrated embodiment, it should be appreciated that any block housing a fuse for the purposes of controlling power between a power source and an electrical device is contemplated by the present invention. For example, fuse block 50 may include a single fuse or any number of fuses greater than one.

Base plate 76 is mounted onto the inner surface of rear wall 60 and configured such that upper wall 70 extends outwardly towards door 66 in accordance with the preferred embodiment. However, it should be appreciated that fuse block 50 may be mounted on any surface within the cabinet 52 such that sufficient clearance exists for the removal of cover 82, and fuses 80 are accessible to a user performing maintenance operations.

A rotatable operator 84 is mounted to fuse block housing 51 and extends upwardly and adjacent side wall 74. The base (not shown) of operator 84 is connected to a set of contacts that are in the path of current flow between the power source and fuses 80. Operator 84 has a substantially square cross section and is rotatable to selectively close and open the contacts which, in turn, electrically engage and disengage fuses 80 with respect to the power source. While operator 84 has essentially a square cross section in accordance with the preferred embodiment, it should be appreciated that operator 84 may have a cross section of any shape that may be engaged by actuator 88 to rotate the operator 84. During operation, operator is rotated counterclockwise along the direction of arrow C to open the set of contacts, thereby disconnecting the fuses 80 from the power source. Once operator 84 is in the "OFF" position, it may be rotated clockwise along the direction of arrow D to reengage the contacts and reestablish connection between fuses 80 and the power source.

Unlike conventional designs, operator 84 is not actuated by a door knob, and therefore does not span the entire depth of cabinet 52 through the entire transverse width of side wall 58. Accordingly, fuse block housing 51 may be provided having a shortened operator 84 with respect to conventional designs. Advantageously, a conventional fuse block housing such as the type illustrated in FIG. I may alternatively be modified by the end user by cutting operator 30, thereby shortening its length and rendering fuse block 22 compatible with the present invention. In this regard, it should be appreciated that the present invention provides a kit for the modification of preexisting fuse blocks.

The rotation of operator 84 is controlled by switching assembly 86, which includes the actuator 88 having a stationary member 89 that is fixed with respect to the fuse block 50, and a movable member 118 that is linked to the stationary member 89 and is operable to rotate operator 84 during use. In particular, stationary member 89 includes a bracket 90 disposed laterally outwardly and adjacent with respect to fuse block housing 51.

Bracket 90 includes a horizontal base member 92 that extends downstream from a location proximal edge 77. Base member 92 is mounted to base 76 via screws 94, and is integrally connected to a vertical wall 96 extending upwardly from the laterally outer edge of base member 92.

Wall 96 defines opposing upwardly extending front and rear edges 98 (front edge shown) that terminate at a horizontal upper edge 100.

A first rectangular vertical flange 102 extends laterally outwardly from the front edge 98 of vertical wall 96 proximal upper edge 100. A rectangular second vertical flange 104 extends laterally outwardly from the rear edge of vertical wall 96 proximal upper edge 100, such that first flange 102 is disposed upstream of second flange 104. The combination of flanges 102 and 104 and vertical wall 96 defines a bracket 106 that extends in the direction of extension of cable assembly 144. Each flange 102 and 104 defines corresponding circular apertures 108 and 109 extending horizontally there through, respectively, that are laterally and vertically aligned with each other.

Stationary member 89 further includes a third rectangular flange 110 that extends laterally outwardly from wall 96 in a horizontal orientation at a location upstream of flange 104 and has a bottom surface 113. A vertically extending circular aperture 112 extends through the laterally outer end of flange 110. A fourth rectangular flange 114 extends laterally outwardly from wall 96 in a vertical orientation, and is disposed downstream of brackets 102, and upstream of bracket 110. A laterally elongated horizontal slot 116 extends through bracket 114 at a location below the bottom surface 113 of flange 110.

Movable member 118 includes a horizontal base 120 that is elongated in the longitudinal direction. Base 120 terminates at a downstream end 121 that is substantially vertically aligned with rear edge 79 of base 76. Downstream end 121 is integrally connected to a rectangular vertical flange 122 extending upwardly from end 121. Flange 122 defines a substantially circular aperture 124 extending horizontally therethrough such that aperture 124 is generally aligned with apertures 108 and 109 of stationary member 89. Base 120 terminates at its upstream end at a tongue 123 that extends upstream through slot 116.

Movable member 118 further includes a rectangular horizontal flange 140 extending laterally outwardly from the base 120 at a position downstream of flange 110 when operator 84 is in the "ON" position, and upstream of flange 122. A substantially circular aperture 142 extends vertically through flange 140, and is in longitudinal and lateral alignment with aperture 112 extending through flange 110. The combination of flanges 110 and 140 define a locking mechanism when actuator 88 is in the "OFF" position, as will be described in more detail below.

Referring now also to FIG. 4A, movable member 118 further includes a pair of rectangular upper and lower horizontal flanges 126 that are attached to the upper and lower surface of base 120, respectively. Flanges 126 extend laterally inwardly from base 120, and define a vertical gap there between. Flanges 126 are joined approximately at their midpoint via a pin 128 that extends there between.

A horizontal arm 130 includes an inner mounting member 132 integrally connected to an outer engagement member 134. Inner mounting member defines an elongated oval-shaped slot 136 extending there through having a corresponding oval,shaped outer wall 133. Slot 136 is sized to receive pin 128 therein so as to be rotatable and translatable with respect to the pin 128. Outer engagement member 134 defines a substantially circular outer wall 135 having an aperture 138 extending vertically there through that has a substantially square cross section sized to receive rotatable operator 84 therein In this regard, it should be appreciated that aperture 138 may be of any size and shape so as to engagingly receive operator 84. For instance, operator 84 and aperture 138 may have any noncircular cross-section such that the edges that define aperture 138 engage the outer edges of operator 84 such that rotation of engagement member 134 correspondingly rotates operator 84. Alternatively, operator 84 may have a circular cross-section that may be engaged by engagement member 134 via a locking pin or alternative mechanism as is appreciated by one having ordinary skill in the art. Arm 130 thus provides a linkage between movable member 118 and rotatable operator 84.

Figure 5:
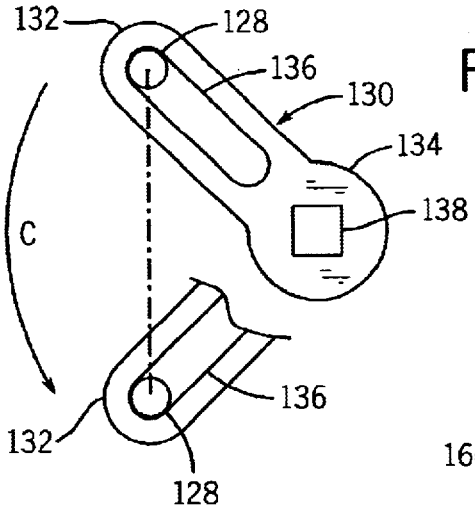
FIG. 5 is a side elevation view illustrating the linkage of the actuating mechanism illustrated in FIGS. 4*a* and 4*b* being rotated from the "ON" position to the "OFF" position.

Referring now also to FIGS. 4*b* and 5, when movable member 118 is translated from its downstream "ON" position to its upstream "OFF" position along the direction of arrow F, the upstream movement of pin 128 causes linkage 130 to translate and rotate with respect to pin 128. The movement of mounting member 132 causes outer engagement member 134 to pivot in the counterclockwise direction about aperture 138. Because rotatable operator 84 extends through aperture 138 and is rotatably fixed thereto, the rotation of member 134 causes linkage 130 to correspondingly rotate operator 84 in the counterclockwise direction of arrow C to disconnect fuse block 50 from its power source. Correspondingly, downstream movement of movable member causes aperture 138 to rotate clockwise, thereby correspondingly rotating operator clockwise in the direction of Arrow D to reconnect fuse block with the power source.

Advantageously, when the actuator 88 is configured to disconnect the fuse block from the power source, base 120 is translated to its upstream position as tongue 123 travels upstream through slot 116. As base 120 translates upstream, flange 140 is brought into vertical alignment with flange 110, such that corresponding apertures 142 and 112 are aligned when the actuator is in its full upstream position. A user is thus advantageously able to lock fuse block 50 in its off position by inserting a padlock or the like through apertures 112 and 142 to prevent electricity from flowing through fuse block 50 while cabinet door 66 is open. In order to reconnect the fuse block 50 to its power source, the maintenance personnel will first have to remove the lock before movable member 118 may once again travel downstream.

Figure 7:
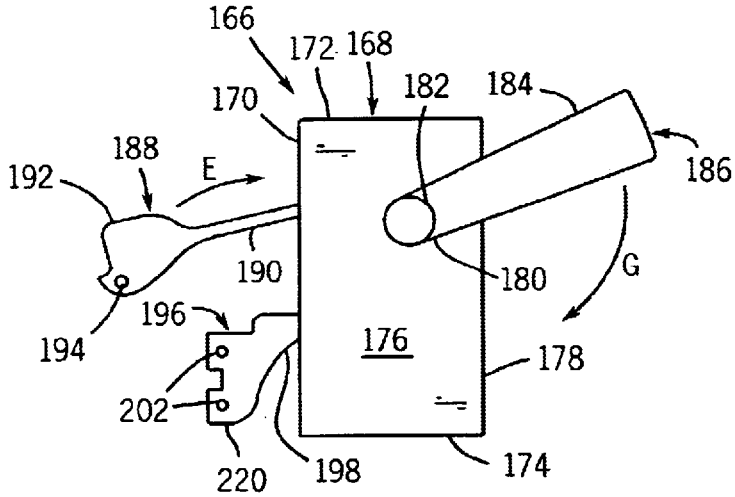
FIG. 7 is a side elevation view of a handle portion of the handle mechanism illustrated in FIG. 3 in the "ON" position.

Referring now to FIGS. 3 and 7, handle mechanism 166 includes an outer housing block 168 having a front wall 170 that is configured to be mounted to the outer surface of wall section 62 of cabinet 52 in a vertical orientation. Housing block 168 further includes an upper wall 172 and lower wall 174 that are connected to side walls 176. A rear wall 178 is connected to the outer edges of walls 172, 174, and 176. A pair of handle arms 180 is connected to side walls 176 via a pin 182 that extends laterally through housing block 168. Handle arms 182 are joined at their distal end 184 to provide a handle 186 having sufficient clearance with reselect to rear wall 178 of housing block 168 during operation Handle 186 is rotatable downwardly in the direction of Arrow G from its upper "ON" position illustrated in FIG. 7 to its lower "OFF" position illustrated in FIG. 3, and vice versa Housing block 168 further includes a linkage arm 188 having a neck 190 that extends outwardly and slightly downwardly from wall 170 and terminates at a connector 192. Neck 190 extends into housing block 168, and is in mechanical communication with handle 186 by one of many well known techniques in the art. Connector 192 defines a mounting location 194 in the form of an aperture extending there through. Housing block 168 further includes a locking arm 196 having a neck 198 that extends outwardly from wall 170, and is also linked to movement of handle 186. Neck 198 terminates at a connector 200 having a pair of connection locations 202 in the form of apertures extending there through. It should thus be appreciated that wall portion 62 includes openings formed therein (not shown) to accommodate linkage arm 188 and locking arm 196 that extend into the interior of cabinet 52.

When handle 186 is rotated to the "OFF" position, locking arm 196 becomes engaged and prevents handle 186 from being rotated to the "ON" position until arm 196 is released. Locking arm 196 may be depressed manually to unlock the handle 186, or released automatically upon shutting the door 66 and locking the door latch 68. In particular, connection locations 202 of locking arm 196 are placed in mechanical communication with door latch 68, such that when the door is closed, activating latch 68 depresses locking arm 196, which enables handle 186 to be rotated to its "ON" position. Furthermore, once the handle 186 is in the "ON" position, locking arm 196 translates upwardly to prevent a user from opening latch 68 until the handle 186 is rotated to the "OFF" position.

Figure 8:
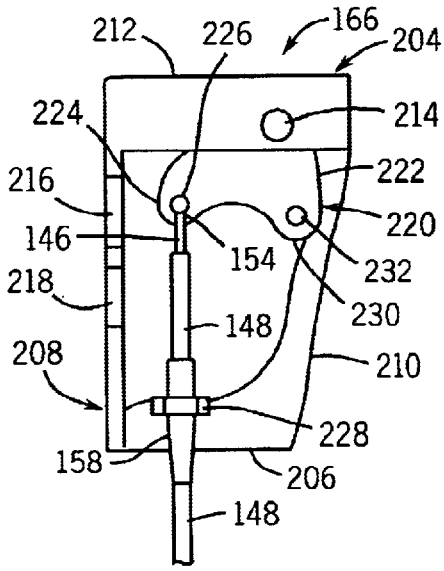
FIG. 8 is a side elevation view of a mounting bracket of the handle mechanism illustrated in FIG. 3 in the "ON" position.

Referring now also to FIG. 8, handle mechanism 166 further includes a mounting bracket 204 having a lower beam 206 connected at one end to a front wall 208, and connected at its other end to a rear wall 210. Front wall 208 is defined herein to be disposed "inwardly" with respect to rear wall 210. Front wall 208 is configured to be mounted to the inner surface of wall section 62, and includes a pair of upper and lower vertically extending notches 216 and 218, respectively, that are configured to receive necks 190 and 198 of linkage arm 188 and locking arm 196, respectively.

Walls 208 and 210 are connected to one of a pair of upper beams 212 (one shown) that are spaced apart from each other at their front end by the thickness of wall 208 at its front end, and spaced apart from each other at their rear end by a pin 214 extending there through. A swivel arm 220 has a proximal end 222 that is pivotally connected to pin 214. Arm 220 has a first distal end 224 extending inwardly and slightly downwardly from proximal end 222 that has a connection location 226 in the form of an aperture extending there through. A horizontal bracket 228 extends across lower beam 206 at a position in substantial vertical alignment with connection location 226. Arm 220 further includes a second distal end 230 extending downwardly and slightly inwardly from proximal end 222 that has a connection location 232 in the form of an aperture. Connection 232 is configured to connect to connection 194 via a locking pin or the like to rotatably connect linkage arm 188 to swivel arm 220.

Referring now to FIGS. 3, 4A. 4B, and 6, the cable assembly 144 includes a tubular metal cable member 146 that is surrounded by a stiff rubber or plastic tubular outer sleeve 148. Outer sleeve 148 defines a proximal end 158 that extends through bracket 228 which is subsequently tightened to affix the proximal end 158 of the outer sleeve 148 to the mounting bracket 204 of handle mechanism 166. Outer sleeve 148 defines a distal end 156 that is fastened to flange 102 of stationary member 89 via a mounting sleeve 160 that surrounds sleeve 148 at its distal end. Sleeve 160 extends through aperture 108 and is threaded to support a pair of locking nuts 164 that are tightened on either side of flange 102. Cable 146 defines a distal end 150 that extends downstream of the distal end of sleeve 148. Distal end 150 of cable 146 has a threaded portion that extends through aperture 124 and connected to flange 122 of movable member 118 by a pair of locking nuts 152 that are tightened on either side of flange 118. Cable 146 further defines a proximal end 154 that extends upstream beyond the proximal end of outer sleeve 148. Proximal end 154 of cable 146 is fastened to connection location 226 of first distal end 224 of swivel arm 220 via a pin or the like.

The operation of switching assembly 86 will now be described with reference to FIGS. 3, 6, 7, and 8. In particular, when the handle 186 is in the "ON" position as illustrated in FIG. 7, the linkage arm 188 is extended. Arm 188 biases distal end 230 of swivel arm 220 outwardly, causing arm 220 to pivot counterclockwise about pin 214, which in turn causes mounting location 226 of distal end 224 to translate downwardly. Swivel arm 220 thus biases cable 146 downstream, which in turn biases movable member 118 downstream. As described above with reference to FIGS. 4A, 4B, and 5, the downstream movement of flange 126 causes linkage 130 to pivot clockwise about aperture 138. The rotation of aperture 138 causes operator 84 to rotate clockwise, thereby connecting fuse block 50 to the power source.

When handle 186 is rotated downwardly to its "OFF" position illustrated in FIG. 3, linkage arm 188 is retracted along the direction indicated by arrow E which, in turn, rotates swivel arm 220 clockwise about pin 214. Clockwise rotation causes mounting location 226 of distal end 224 to translate upwardly. Swivel arm 220 thus biases cable 146 upstream, which in turn biases movable member 118 upstream. As described above with reference to FIGS. 4A, 4B, and 5, the upstream movement of flange 126 causes linkage 130 to pivot counterclockwise about aperture 138. The rotation of aperture 138 causes operator 84 to rotate counterclockwise, thereby disconnecting fuse block 50 to the power source.

Advantageously, the locking arm is linked to the linkage arm in the housing block 168 (not shown) such that once handle 186 has been rotated to the "OFF" position, handle arm remains locked in the off position until the cabinet door 66 is closed and latch 68 activated to release the locking arm 196, or until a user manually unlocks locking arm 196.

The above has been described as a preferred embodiment of the present invention It will occur to those that practice the art that many modifications may be made without departing from the spirit and scope of the invention. For example, while stationary member 89 is affixed to the base 76 of fuse block 50, it should be appreciated that member 89 could be disposed anywhere within cabinet 52 such that its position is fixed with respect to fuse block 50 to enable movable member 118 to rotate operator 84. In order to apprise the public of the various embodiments that may fall within the scope of the invention, the following claims are made.

I claim:

1. A switching apparatus for a fuse block disposed in a cabinet, the fuse block being of the type having at least one fuse operable to conduct current from a power source to a load and a rotatable operator extending along an axis that is operable to rotate about the axis between a closed and open position to correspondingly electrically connect and disconnect the fuse block with respect to the power source, the switching apparatus comprising:

a handle mechanism that is mountable to a cabinet surface and movable between a first position and a second position;

an actuating mechanism including:

i. a stationary member fixed relative to the fuse block;

ii. a movable member movably connected to the stationary member; and iii. a linkage linked to the movable member and connected to the rotatable operator for rotating the rotatable operator in response to movement of the movable member; and a cable assembly attached to the handle at a first end and attached to the actuating mechanism at a second end opposite the first end;

wherein movement of the handle mechanism from the first position to the second position causes the cable assembly to translate the movable member with respect to the fuse block, thereby rotating the linkage and rotatable operator to electrically disconnect the fuse block from the power source.

2. The switching mechanism as recited in claim 1, wherein the fuse block includes a base member that is mounted to an inner surface of the cabinet, and wherein the stationary member is mounted to the base.

3. The switching mechanism recited in claim 1, wherein the actuating mechanism further comprises a tongue extending from the movable member that is inserted into a corresponding slot formed in the stationary member for translation of the movable member relative to the fuse block.

4. The switching mechanism recited in claim 3, wherein the linkage comprises a swing arm having a first and second end, wherein the first end is pivotally and translatably mounted to the movable member at one end, and wherein the second end is configured to be rotatably connected to the rotatable operator.

5. The switching mechanism recited in claim 4, wherein the rotatable operator has a noncircular cross section, and wherein the second end of the swing arm defines a bore extending therethrough having noncircular cross section, and wherein the rotatable operator is configured to extend through the bore.

6. The switching mechanism recited in claim 4, wherein translation of the movable member from a first position to a second position causes the swing arm to rotate about the rotatable operator.

7. The switching mechanism as recited in claim 6, wherein the stationary member includes a first flange extending outwardly therefrom having an aperture extending therethrough, and wherein the movable member has a second flange extending outwardly therefrom having an aperture extending therethrough that becomes aligned with the aperture of the first flange when the movable member is in the second position.

8. The switching apparatus as recited in claim 1, wherein the handle mechanism further includes a handle extending outwardly from the cabinet surface, and a second arm extending inwardly from the cabinet surface and linked to the handle, wherein the second arm moves in response to movement of the handle.

9. The switching apparatus as recited in claim 8, wherein the cable assembly further comprises a cable surrounded by an outer sleeve, wherein the cable is attached to the handle mechanism at a first end and attached to the movable member at a second end opposite the first end, and wherein the sleeve is connected to the handle mechanism at a first end and connected to the stationary member at a second end opposite the first end.

10. The switching mechanism as recited in claim 9, wherein the handle mechanism further comprises a mounting bracket that is connected to an inner side of the cabinet surface, wherein the mounting bracket includes a bracket swing arm that is pivotally mounted to the mounting bracket at a center position, linked to the second arm at a first outer position, and connected to the first end of the cable at a second outer position.

11. The switching mechanism as recited in claim 10, wherein the first end of the outer sleeve is connected to the mounting bracket.

12. The switching mechanism as recited in claim 11, wherein movement of the first arm from the first to the second position causes the rotatable operator to be rotated to the open position, and wherein the lever arm becomes releasably locked in the second position.

13. A kit for converting a fuse block having a base that is mounted to a cabinet surface, the fuse block being of the type having at least one fuse operable to conduct current from a power source to a load and a rotatable operator extending along an axis that is operable to rotate about the axis between a closed and open position to correspondingly engage and disengage the fuse block with respect to the power source, the kit comprising:

a handle mechanism configured to be mounted to a cabinet surface, the assembly including, i. a handle extending outwardly from the cabinet surface;

ii. a bracket assembly connected to an inner side of the cabinet surface; and iii. a bracket swing arm supported by the bracket assembly and in mechanical communication with a first lever arm;

wherein the handle is movable between a first position and a, second position to actuate the bracket swing arm between a corresponding first and second position;

an actuating mechanism for rotating the rotatable operator between on and off positions, the actuating mechanism including:

i. a stationary member that is configured to be mounted to the base;

ii. a movable member movably connected to the stationary member; and iii. a linkage having a first end linked to the movable member and a second end operable to rotate the rotatable operator; and a cable surrounded by an outer sleeve, wherein the cable is attached to the swing arm at a first end and attached to the movable member at a second end opposite the first end, and wherein the sleeve is attached to the bracket assembly at a first end and attached to the stationary member at a second end opposite the first end;

wherein movement of the handle from the first position to the second position causes the cable to move the movable member with respect to the fuse block, thereby causing the linkage to rotate the rotatable operator to the open position.

14. The kit as recited in claim 13, wherein the actuating mechanism comprises a swing arm translatably and pivotally mounted to the movable member at a first location, and rotatably connected to the rotatable operator at a second location, wherein movement of the movable member from a first to a second position causes the second location of the swing arm to rotate the rotatable operator.

15. The switching mechanism as recited in claim 14, wherein the stationary member includes a flange extending outwardly therefrom having an aperture extending therethrough, and wherein the movable member includes a flange extending outwardly therefrom, wherein the apertures become aligned when the movable member is in the second position.

16. The kit as recited in claim 13, wherein the actuating mechanism comprises a tongue extending outwardly from the movable member that engages a corresponding slot in the stationary member for translation of the movable member with respect to the fuse block.

17. The kit as recited in claim 13, wherein the handle mechanism further comprises a second arm linked to the handle, wherein the second arm rotates in response to movement of the handle, and wherein the bracket swing arm is connected to the second arm.

* * * * *